US007753411B2

(12) United States Patent
Silverman

(10) Patent No.: US 7,753,411 B2
(45) **Date of Patent: *Jul. 13, 2010**

(54) ELASTOMERIC BOOK COVER

(75) Inventor: Robert S. Silverman, Long Beach, CA (US)

(73) Assignee: Kittrich Corporation, La Mirada, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/335,630

(22) Filed: Dec. 16, 2008

(65) Prior Publication Data

US 2009/0250919 A1 Oct. 8, 2009

(51) Int. Cl.
*B42D 3/00* (2006.01)
*B42D 3/10* (2006.01)

(52) U.S. Cl. ..... 281/36; 281/31; 281/34; 281/35

(58) Field of Classification Search ..... 281/15.1, 281/31, 51, 19.1, 29, 34, 35, 45–47; 428/423.1, 428/423.7, 328, 325
See application file for complete search history.

(56) References Cited

U.S. PATENT DOCUMENTS

| | | | | |
|---|---|---|---|---|
| 913,036 | A | 2/1909 | Reynolds | |
| 1,479,791 | A | 1/1924 | Degenring | |
| 1,540,297 | A | 6/1925 | Walraven | |
| 1,595,002 | A | 8/1926 | Davis | |
| 2,057,987 | A | 10/1936 | Walraven | |
| 2,753,194 | A | 7/1956 | Correa | |
| 3,222,085 | A * | 12/1965 | Young | 281/34 |
| 3,905,848 | A | 9/1975 | Williams | |
| 4,366,382 | A | 12/1982 | Kotowski | |
| 4,519,630 | A | 5/1985 | Holmes | |
| 4,541,364 | A | 9/1985 | Contello | |
| 4,715,619 | A | 12/1987 | Sloot | |
| 4,744,592 | A | 5/1988 | Barnette et al. | |
| 4,893,979 | A | 1/1990 | Alpers | |
| 4,979,137 | A | 12/1990 | Gerstenfeld et al. | |
| 5,004,514 | A | 4/1991 | Pugliese et al. | |
| 5,013,068 | A * | 5/1991 | Maldonado | 281/31 |
| 5,029,900 | A | 7/1991 | Axelrod | |
| 5,056,663 | A | 10/1991 | Ostrowski | |
| 5,092,630 | A | 3/1992 | Ostrowski | |
| 5,158,325 | A | 10/1992 | Landis | |
| 5,207,717 | A | 5/1993 | Manning | |
| 5,209,624 | A | 5/1993 | Nocolaisen | |
| 5,219,437 | A | 6/1993 | Moor | |
| 5,243,693 | A | 9/1993 | Maron | |
| 5,247,561 | A | 9/1993 | Kotowski | |
| 5,470,109 | A | 11/1995 | Grande | |

(Continued)

FOREIGN PATENT DOCUMENTS

| | | |
|---|---|---|
| GB | 683885 | 10/1952 |

(Continued)

*Primary Examiner*—Dana Ross
*Assistant Examiner*—Pradeep C Battula
(74) *Attorney, Agent, or Firm*—Patentmetrix

(57) ABSTRACT

A book cover, formed from an elastomeric polymer material, has pocket portions for receiving the covers of a book. The pocket portions form an elliptically shaped access slot that encases covers inserted into the pocket portion and have peripheral edges that fold over and cover the top and bottom edge of the book spine.

10 Claims, 4 Drawing Sheets

U.S. PATENT DOCUMENTS

| | | | | |
|---|---|---|---|---|
| 5,535,506 | A | 7/1996 | Chalfin | |
| 5,590,057 | A | 12/1996 | Fletcher et al. | |
| 5,660,549 | A | 8/1997 | Witt, III | |
| 5,851,031 | A | 12/1998 | Golson | |
| 5,882,206 | A | 3/1999 | Gillio | |
| 5,992,886 | A | 11/1999 | Udd | |
| 6,044,353 | A | 3/2000 | Pugliese, III | |
| 6,137,895 | A | 10/2000 | Al-Sheikh | |
| 6,257,622 | B1 | 7/2001 | Peker | |
| 6,301,327 | B1 | 10/2001 | Martens et al. | |
| 6,552,346 | B2 | 4/2003 | Verbinski et al. | |
| 6,707,879 | B2 | 3/2004 | McClelland et al. | |
| 6,721,391 | B2 | 4/2004 | McClelland et al. | |
| 6,899,540 | B1 | 5/2005 | Neiderman et al. | |
| 6,901,346 | B2 | 5/2005 | Tracy et al. | |
| 7,290,801 | B2 | 11/2007 | Silverman | |
| 7,334,819 | B2 | 2/2008 | Silverman | |
| 7,478,837 | B2 * | 1/2009 | Silverman | 281/36 |
| 2003/0234531 | A1 | 12/2003 | Silverman | |
| 2004/0066031 | A1 | 4/2004 | Wong | |
| 2006/0091668 | A1 | 5/2006 | Silverman | |
| 2007/0085329 | A1 | 4/2007 | Silverman | |

FOREIGN PATENT DOCUMENTS

| | | |
|---|---|---|
| WO | WO2006/110959 | 4/2006 |

* cited by examiner

ELASTOMERIC BOOK COVER

This application claims the benefit of U.S. patent application Ser. No. 10/534,448, filed on May 10, 2005, which claims the benefit of U.S. Provisional application number 60/425,671, filed Nov. 11, 2002, which is incorporated by reference herein in its entirety.

BACKGROUND OF THE INVENTION

This invention relates to adjustable book covers, and more particularly to protective elastomeric coverings that may be used with a variety of book sizes.

Numerous book covers have been devised to protect schoolbooks and other hard covered texts from moisture, dirt or grime. Many of these coverings utilize Kraft™ paper wrappings or have been fabricated from more durable plastic materials. The application of such book jackets require the time consuming steps of trimming the covering to size, fashioning and folding flaps, then inserting the front and back panels of a bound book into lateral envelopes formed by the flaps. Adhesive tape may also be required to secure the protective covering into position which typically will mar a text when removed. Some conventional plastic book covers are similarly available with a coating of repositionable pressure sensitive adhesive. Although intended to removably adhere to the exposed surfaces of a book, such coverings are known to become troublesome to remove after long term usage. Alternatively, stretchable fabric book covers—which have attempted to remedy the problems of paper coverings and self adhesive plastic sleeves—do not provide a uniform waterproof barrier and fall short of protecting the vulnerable surfaces of a book.

For example, U.S. Pat. No. 5,004,514 issued to Pugliese et al. discloses a method of making a protective book covering, comprising a relatively long piece of plastic sheet material and a relatively short piece of plastic sheet material overlying the long piece, with longitudinal edges of the two sheets being heat sealed together, and the alternative option of applying a strip of adhesive to secure one of the longitudinal edges.

U.S. Pat. No. 5,013,068 issued to Maldonado discloses a protective envelope for a book comprising a bi-directional stretchable sheet of compressible synthetic polymer fabric and a relatively thick layer of closed cell elastomeric compressible foam, lined on one side. The stretchable composite sheet may comprise foamed neoprene and stretchable nylon, the foam having a thickness between about 1/32 inch and 1/16 inch. The edges of the stretchable composite sheet are secured by a sewn stretchable seam binding.

U.S. Pat. No. 5,029,900 issued to Axelrod discloses a wrap-around plastic cover for a bound book formed from a rectangular sheet having a center portion that abuts the book spine, with end portions of the sheet folded inwardly to enclose the front and rear covers of a book to be protected. The distal portions of the rectangular sheet thus form inwardly facing flaps to receive the front and rear covers of the book as a removable cover.

U.S. patents issued to Ostrowski (U.S. Pat. Nos. 5,056,663 and 5,092,630), disclose adjustable protective book covers having similar features. The Ostrowski '663 patent discloses an adjustable cover having releasable hook and loop fasteners or adhesives which serve to secure a book within the cover. The Ostrowski '630 patent discloses a one-size-fits-all book cover which comprises sheet material with folded over top and bottom edges and sides with short hems. The side edges are folded over to form side pockets for insertion of the covers of a book therein.

U.S. Pat. No. 5,470,109 issued to Grande discloses an adjustable book cover made from elastic fabric which is cut in a unique diamond shaped pattern wherein two diagonal stitched seams converge to form the apex of a triangle for inserting front and back book cover portions. The "spine locking" feature does not work effectively. The adjustable cover leaves exposed the top and bottom spine edge portions of the covered book—exposing such areas to potential scuffs and scrapes. In order to stay above the spine area and not sag, the cover must be made to protrude significantly.

U.S. Pat. No 5,158,325 issued to Landis et al. discloses an adjustable book cover similar to that taught by Grande, except that the insertable book cover forms pockets with a sinusoidal stitched seam at the lip of the insert portion of the cover. An integral, non-removable book marker appears to be superfluous and lacking utility to the function of protecting the book. Firstly, book pages may be readily segregated within the front and/or the back flap areas of the cloth book cover, without adversely affecting book closure, and without damage to the pages, covers, or spine of the book. Secondly, an attached book marker is cumbersome if not utilized, adding bulk to the inside of the book.

U.S. Pat. No. 6,257,622 issued to Peker discloses a cloth book cover, preferably of spandex, the cover having end pockets to receive the front and back covers of a book in inserted relation therein. The top and bottom edges of the cover are stitched, the protruding portions of which tend to promote local wear. The formation of the end pockets requires the undue extension of the cover material—when inserting a book within the cover in regular fashion—without first reverse bending the book spine in order to successfully fit the book cover.

Therefore, there is a need for an elastomeric book cover that is both adjustable and reusable, that also provides adequate protection to the book.

BRIEF SUMMARY OF THE INVENTION

It is an object of the present invention to provide an adjustable and reusable elastomeric book cover that is not only easy to apply, but offers protection against water damage and soiling.

It is a further object of the present invention to provide a book cover consisting of a unitary construction for ease of use and durability.

The present invention features a waterproof book cover that is molded from an elastomeric material that closely envelops the exterior paperboard panels and spine of a book. The book cover may have pocket portions to receive the paperboard panels of a book. The pocket portions may form a generally elliptical access slot, substantially parallel with the spine of the book, to facilitate the insertion of the book panels.

The book cover may be constructed of a unitary molding, and may have thicker reinforcing periphery edges. The edge portions of the elliptical access slot—bisecting the longer peripheral sides of the subject cover—may reinforced as well. Alternatively, the subject book cover may be molded as a uniform thickness, or such peripheral edge portions may be molded with one or more grooves to secure the elastomeric cover around the perimeter of the paperboard panels of a book.

Many additional features may be incorporated into the book cover. For example, the elastomeric material may be transparent, clear, tinted, fluorescent, opaque, colored, or compounded with metallic or other reflective polyester particles, glitter, for example. Alternatively, the book cover may be constructed from a variety of materials to produce multiple effects. By way of example, the book cover may be constructed various colored materials to produce an abstract and/or multicolored effect.

The book cover may also be provided with images thereon. Such designs may be rendered in inks that are compatible with the substrates. In addition to opaque colors that may be utilized, such inks may be transparent, tinted, or compounded with reflective particles.

The book cover may be further provided with textured or patterned surfaces. For example, the surface may be constructed with an embossed or matte surface. As another example, the surface may simulate the texturized coverings of a basketball or football, or may alternatively provide a surface that will enhance the feel and grip of the elastomeric material.

BRIEF DESCRIPTION OF THE DRAWINGS

Certain embodiments of the invention are described by way of illustration without limitation thereto, reference being made to the accompanying drawings, wherein.

DETAILED DESCRIPTION OF EMBODIMENTS OF THE INVENTION

Figure 1:
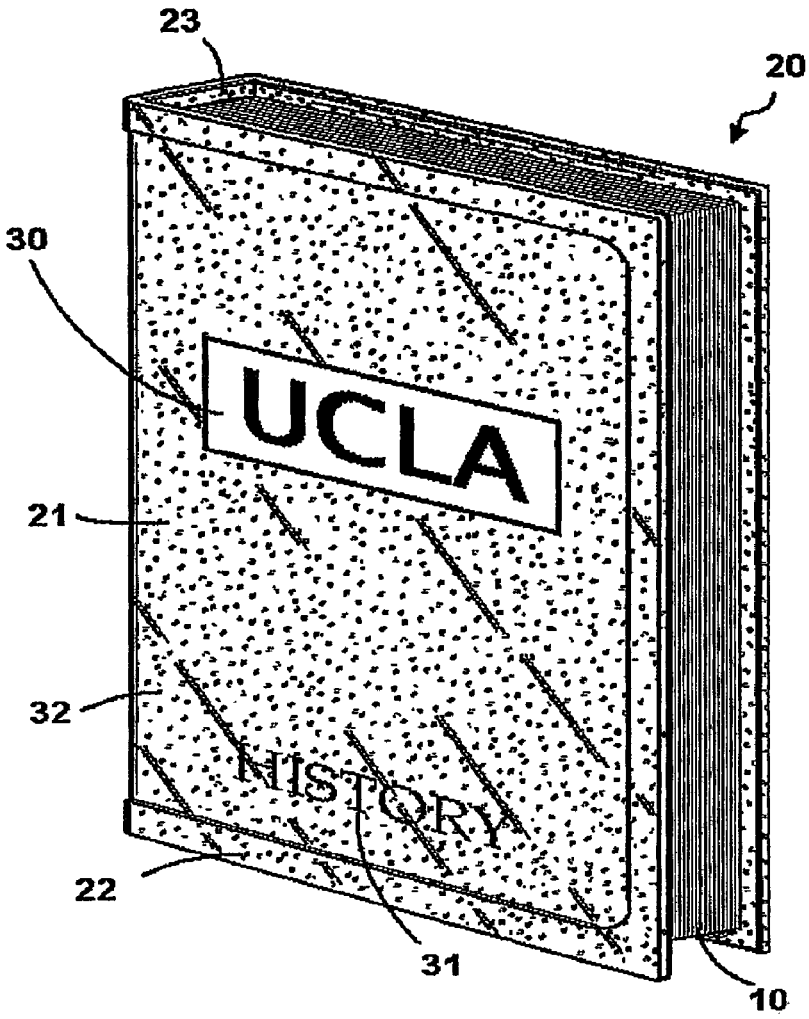
FIG. 1 is a front perspective view showing a book standing on its bottom edge, having the paperboard covers of the book concealed within an elastomeric book cover, in accordance with an embodiment of the present invention.
Figure 2:
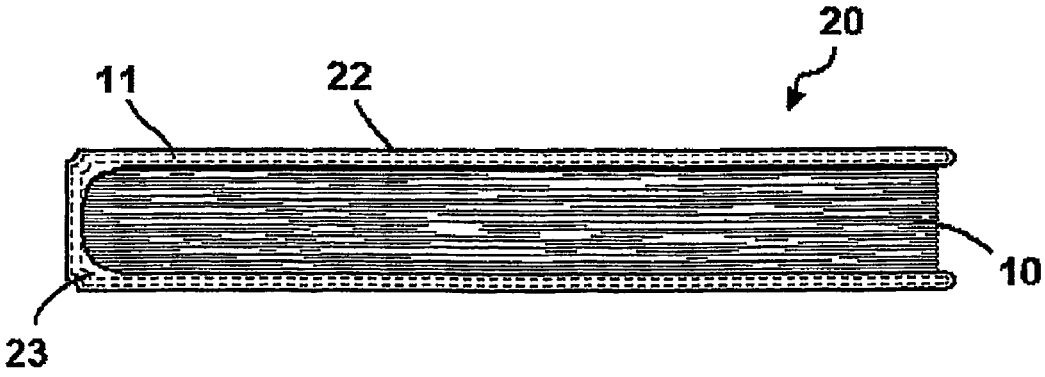
FIG. 2 is a bottom edge view of the book illustrated in FIG. 1.

A book cover 20, shown in FIGS. 1 and 2, may be formed from a suitable elastomeric material, such as, but not limited to, silicone rubber e.g., a Vinyl Methyl Silicone (VMQ) available under the Silastic® brand from Dow Corning Corporation. Silicone rubber is durable, water repellent, resistant to degradation by chemicals or ultraviolet light (such as sunlight), possesses low toxicity, and has the ability to conform to various shapes due to its stretchability. It may also be molded into a variety of shapes and configurations.

A book 10 is shown, the covers of which are contained within and covered by the book cover 20. A reinforcing edge 22 of silicone rubber may be formed, e.g., molded, around the outside edge of the book cover. This helps prevent the peripheral paperboard edges 11 of the book 10 from piercing or tearing the book cover 20. The book cover 20 may have a "spine locking" feature 23, further described below, engaging the top and bottom spine portions of book 10.

Figure 3:
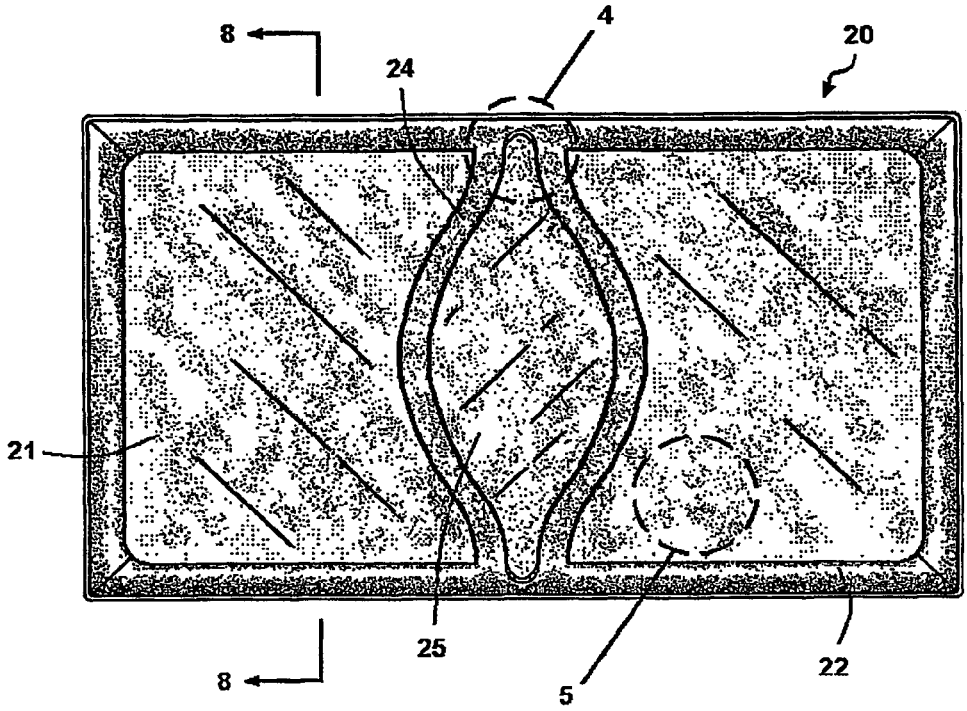
FIG. 3 is an interior plan view of a book cover in an open condition according to an embodiment of the present invention.
Figure 4:
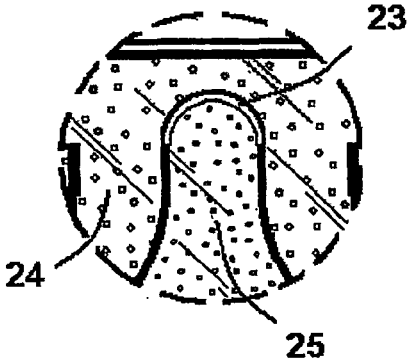
FIG. 4 is an enlarged view of a spine locking feature of a book cover according to an embodiment of the present invention.

Referring further to FIG. 3, a book cover is in an open condition illustrating a generally elliptical access slot 25, which facilitates the insertion of the paperboard panels of a book within the pocket portions of the book cover 20. The peripheral edges 24, of the elliptical access slot 25, may be reinforced in the same manner as the outside edges 22 of book cover 20 described above. The wall thickness of the reinforcing edge 22 may exceed two times the wall thickness of the unreinforced surfaces 21 of the subject cover 20. Wall dimensions of the respective edges 22 and 24 within the range of about 0.025 to about 0.040 of an inch have been found to have adequate durability for book covers made of silicone rubbers. Wall thickness of unreinforced surfaces 21 of such book covers of about 0.012 to about 0.020 of an inch have also been found to be adequate. Shown within FIGS. 3 and 4, the access slot 25 may be molded with a reinforced "spine locking" aperture, indent or recess 23 that engages the top and bottom spine portions of a book.

Figure 5:
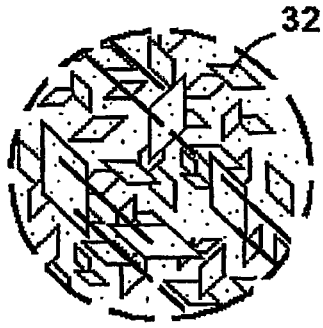
FIG. 5 is an enlarged view of an embodiment of a book cover according to the present invention, whereby reflective particles are suspended in a transparent base of silicone rubber.

Silicone rubber is generally transparent and colorless. Transparent or semi-transparent book covers allow the title 31 or other indicia on the book 10 to be seen through the book cover 20. However, the book cover 20 may include various visual effects. For example, the cover 20 may be imprinted with a design 30 or designs that may be printed from compatible inks, i.e., compatible with the book cover substrate, e.g., silicone rubber. Another example, as illustrated in FIGS. 1, 3 and 5, the cover may contain reflective particles 32. The reflective particles 32 may be suspended in the substrate itself, e.g., the silicone rubber from which the book cover 20 is formed, or reflective particles 32 may be suspended in compatible transparent printing inks and imprinted upon the surfaces of the book cover 20.

The book cover 20 may also be molded from transparent, tinted, florescent, phosphorescent, or opaquely colored materials, for example, liquid silicone rubber. Alternatively, the book cover 20 may be molded from a variety of colored materials, e.g., silicone rubber colors, producing an abstract and/or multicolored effect. Those of ordinary skill in the art will understand how to accomplish the above described and other effects that are within the scope of the invention.

Such effects, besides being ornamental, may serve as a quick visual indicator of the book that is covered. For example, a book cover or book covers having a certain visual effect or effects may identify ownership of the book or books or the particular book or books covered without having to read the title or other indicia.

Figure 6:
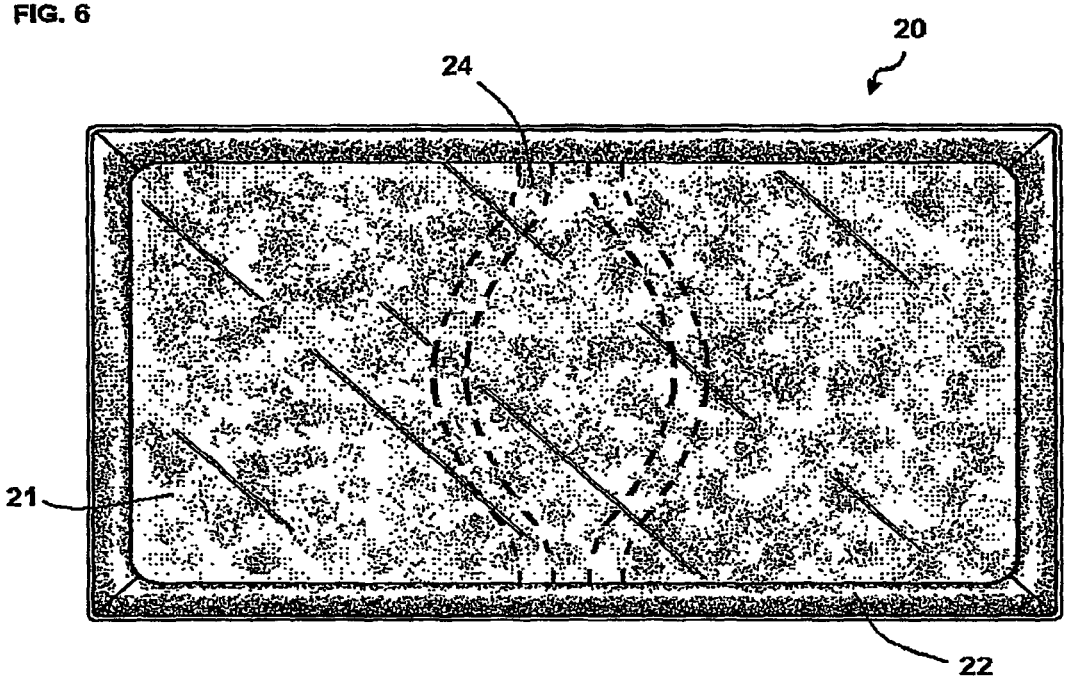
FIG. 6 is an exterior plan view of a book cover in an open condition according to an embodiment of the present invention.

Referring now to FIG. 6, the exterior plan view of a book cover 20 illustrates a reinforcing edge 22 framing thinner semi-transparent unreinforced surfaces 21 as may be included in various embodiments of the invention. Alternatively, the tooling used to mold the cover 20 may provide wall thicknesses of the unreinforced surfaces 21 to be up to the thickness of reinforcing edge 22. In further embodiments, the tooling used to mold the cover 20 may provide a texturized or patterned surface 33 to the external and/or internal surfaces of the cover, as illustrated by the embodiment shown in FIG. 8*e*. Those skilled in the art will appreciate what elastomeric materials may be used to mold book covers of the invention and how to mold them to achieve the desired attributes of the book cover.

Figure 7:
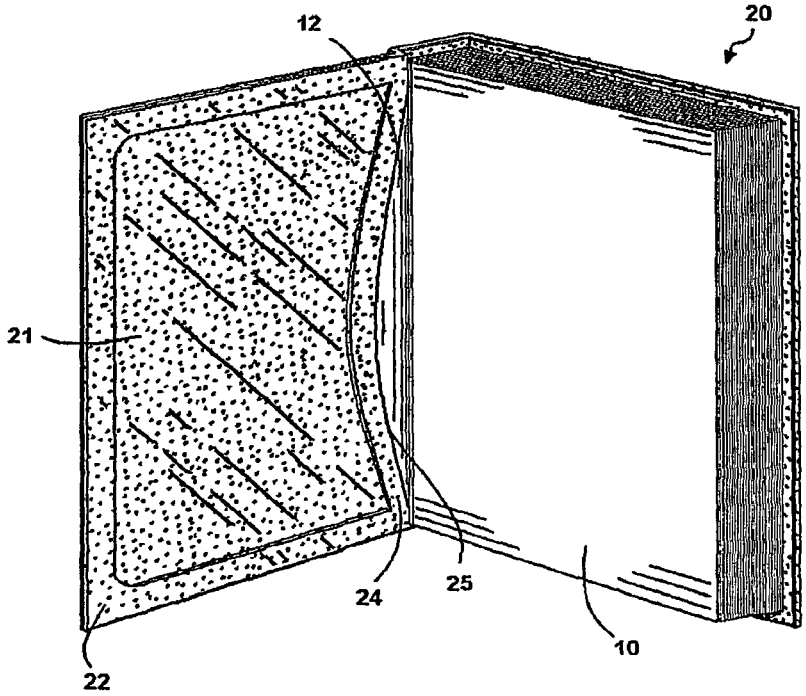
FIG. 7 is a front perspective view of a covered book, showing the book standing on its bottom edge, having the front covered panel of the book in open relation, in accordance with an embodiment of the present invention.

FIG. 7 is a front perspective view a covered book 10 having the front covered panel of the book in open relation. The cover pocket portion's generally elliptical access slot 25, with reinforced edges 24, receives the paperboard panels 12 of book 10. The tension created because of the elastomeric properties of the material, combined with the design of the access slot 25, causes the "spine locking" feature 23 to fold over the top and bottom edges of the spine—protecting such areas of book 10 from soiling and water damage.

Figure 8A:
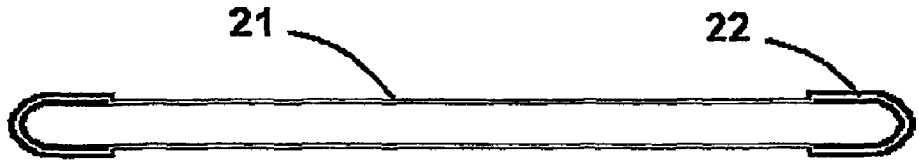
FIGS. 8*a*-8*e* are cross sectional views of other embodiments of book covers in accordance with the present invention.
Figure 8B:
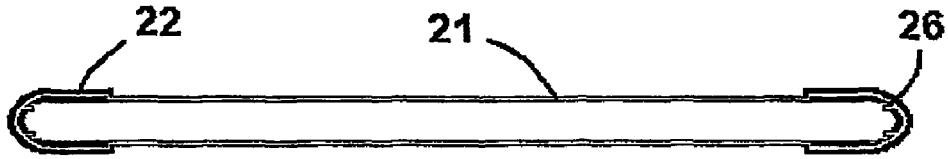
Figure 8C:
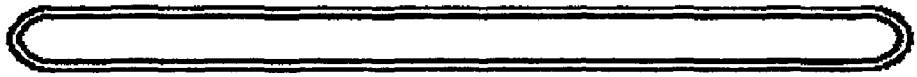
Figure 8D:
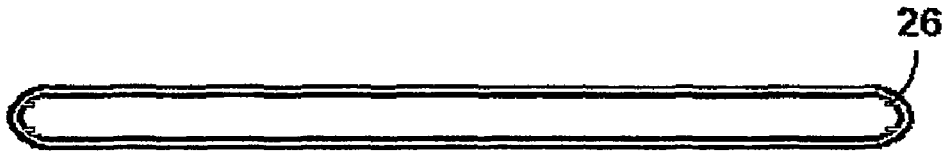
Figure 8E:
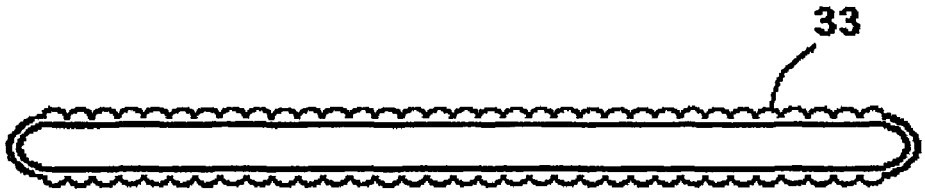

FIGS. 8*a*-8*e* illustrate cross sectional views of additional embodiments of the book cover 20. FIG. 8*a* shows an embodiment whereby a reinforced edge 22 is formed in conjunction with thinner unreinforced sections 21 of book cover 20. The wall thickness of the reinforced edge 22 may be within the range of about 0.024 to 0.040 of an inch, and the wall thickness of the unreinforced sections 21 may be within the range of about 0.012 to 0.020 of an inch, for example, in embodiments constructed of silicone rubbers. FIG. 8*b* illustrates an embodiment having molded grooves 26 at the peripheral reinforcing edge 22 to help secure the elastomeric cover 20 around the perimeter edges of the adjoining paperboard panels 12 of the book 10. FIGS. 8*c* and 8*d* show other embodiments whereby the wall thickness of the subject cover 20 is of a uniform dimension, without and with grooves 26, respectively. FIG. 8*e* shows a further embodiment, wherein the elastomeric cover 20 is molded with a texturized surface 33. Such surfaces may either be an embossed or matte surface, to enhance the feel or grip of the elastomeric material, or even be molded to simulate the texturized coverings of other objects.

While other advantages may be intrinsic to the elastomeric book cover 20, it is to be understood that the present invention is not limited to the sole embodiments described herein. For example, any suitable elastomeric material may be used for the book cover, as will be appreciated. Vinyl Methyl Silicone (VMQ), as used in some embodiments, may be easily substituted with another elastomeric material, e.g., latex. By way of another example, in embodiments containing reflective particles may be die cut into various shapes, for example, miniature hearts or stars.

Having described the invention in detail and by reference to preferred embodiments thereof, it will be apparent that modifications and variations are possible without departing from the scope of the invention herein.

What is claimed is:

1. A book cover comprising: a first pocket portion and a second pocket portion, each pocket portion adapted to receive at least a portion of a cover of a book, wherein each pocket portion comprises an access slot having a top peripheral edge and a bottom peripheral edge, wherein the top peripheral edge of the access slot of the first pocket portion is attached to the top peripheral edge of the access slot of the second pocket portion by an elastomeric material, and wherein the bottom peripheral edge of the access slot of the first pocket portion is attached to the bottom peripheral edge of the access slot of the second pocket portion by an elastomeric material, and wherein the elastomeric material attaching the top peripheral edges automatically folds over and covers the top edge of a spine of the book when the book is inserted into the book cover and said book cover is closed and wherein the elastomeric material attaching the bottom peripheral edges automatically folds over and covers the bottom edge of the spine of the book when the book is inserted into the book cover and said book cover is closed.

2. The book cover of claim 1, wherein each access slot is adapted to be substantially aligned with and parallel to the spine of the book.

3. The book cover of claim 1, wherein the pocket portions are adapted to receive substantially all of the covers of the book.

4. The book cover of claim 1, wherein peripheral edges of the book cover are reinforced.

5. The book cover of claim 1, wherein said peripheral edges are reinforced by the material of the book cover being thicker thereat.

6. The book cover of claim 1, wherein said peripheral edges are at least twice as thick as unreinforced portions of the book cover.

7. The book cover of claim 1, wherein edge portions of the access slot are reinforced.

8. The book cover of claim 1, wherein said edge portions are at least twice as thick as unreinforced portions of the book cover.

9. The book cover of claim 1, wherein the book cover is of unitary construction.

10. The book cover of claim 1, wherein the elastomeric material is selected from the group consisting of silicone rubbers and latex.

* * * * *